US008736500B1

(12) United States Patent
Lam

(10) Patent No.: US 8,736,500 B1
(45) Date of Patent: May 27, 2014

(54) LOOP ANTENNA WITH IMPEDANCE MATCHING

(75) Inventor: Alan Man Lung Lam, Hong Kong (CN)

(73) Assignee: RadioShack Corporation, Fort Worth, TX (US)

( * ) Notice: Subject to any disclaimer, the term of this patent is extended or adjusted under 35 U.S.C. 154(b) by 786 days.

(21) Appl. No.: 12/536,256

(22) Filed: Aug. 5, 2009

(51) Int. Cl.
*H01Q 21/00* (2006.01)
*H01Q 3/00* (2006.01)
*H01Q 9/16* (2006.01)

(52) U.S. Cl.
USPC ..... 343/726; 343/764; 343/821

(58) Field of Classification Search
USPC ..... 343/793, 794, 764, 726, 805, 809, 821
See application file for complete search history.

(56) References Cited

U.S. PATENT DOCUMENTS 4,293,861 A 10/1981 Winegard et al.
4,462,010 A * 7/1984 Strammello ..... 333/126
5,528,251 A 6/1996 Frein
5,552,796 A 9/1996 Diamond
5,764,194 A * 6/1998 Brown ..... 343/726
5,977,842 A * 11/1999 Brown et al. ..... 333/26
6,429,828 B1 * 8/2002 Tinaphong et al. ..... 343/824
7,088,305 B2 * 8/2006 Flask et al. ..... 343/794

* cited by examiner

*Primary Examiner* — Michael C Wimer
*Assistant Examiner* — Hasan Islam
(74) *Attorney, Agent, or Firm* — Dan Brown Law Office; Daniel R. Brown

(57) ABSTRACT

An antenna apparatus that has a base and an antenna element with a balanced RF output, which receives RF signals within a first band of frequencies. The apparatus includes a mount engaged with the base that rotatably supports the antenna about an axis of rotation. The apparatus has a balun with a balanced RF input and an unbalanced RF output. A feed line is coupled between the balanced RF output and the balanced RF input. The feed line includes two electrical conductors that have a predetermined length and that are aligned substantially in parallel, and supportively spaced apart a predetermined distance by plural insulators. The feed line is further arranged to maintain the predetermined distance between the two electrical conductors as the antenna element rotates with respect to the base. The predetermined length and the predetermined distance are selected to yield a narrow range of impedances within the first band of frequencies as measured at the unbalanced RF output of the balun, which enables efficient coupling of the RF signals from the unbalanced RF output of the balun.

14 Claims, 5 Drawing Sheets

Output Impedance (Ohms)
| Freq. MHz | D= 1mm | D=1mm Twisted | D= 4mm | D= 10m | D= 27mm |
|---|---|---|---|---|---|
| 470 | 87 | 91 | 57 | 50 | 40 |
| 500 | 64 | 71 | 37 | 35 | 31 |
| 550 | 122 | 152 | 64 | 52 | 36 |
| 600 | 19 | 15 | 63 | 70 | 99 |
| 650 | 11 | 8.5 | 15 | 16 | 26 |
| 700 | 12 | 7 | 12 | 15 | 22 |
| 750 | 34 | 18 | 46 | 57 | 90 |
| 800 | 90 | 105 | 111 | 105 | 66 |
| Impedance Range | 11:1 | 22:1 | 9:1 | 7:1 | 4:1 |
Fig. 4
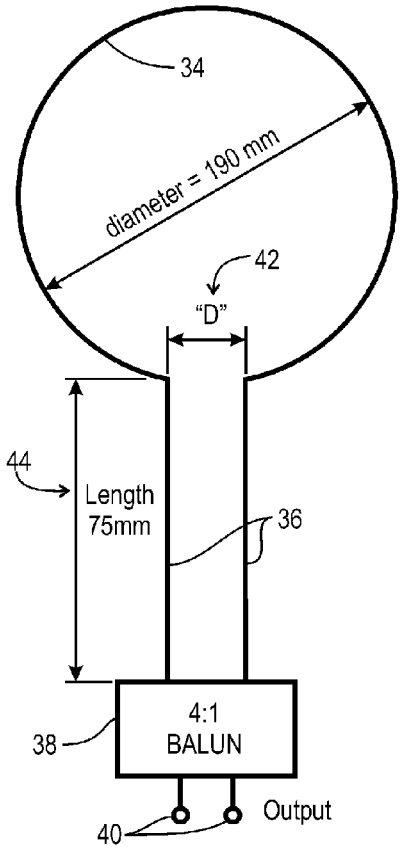
Fig. 3
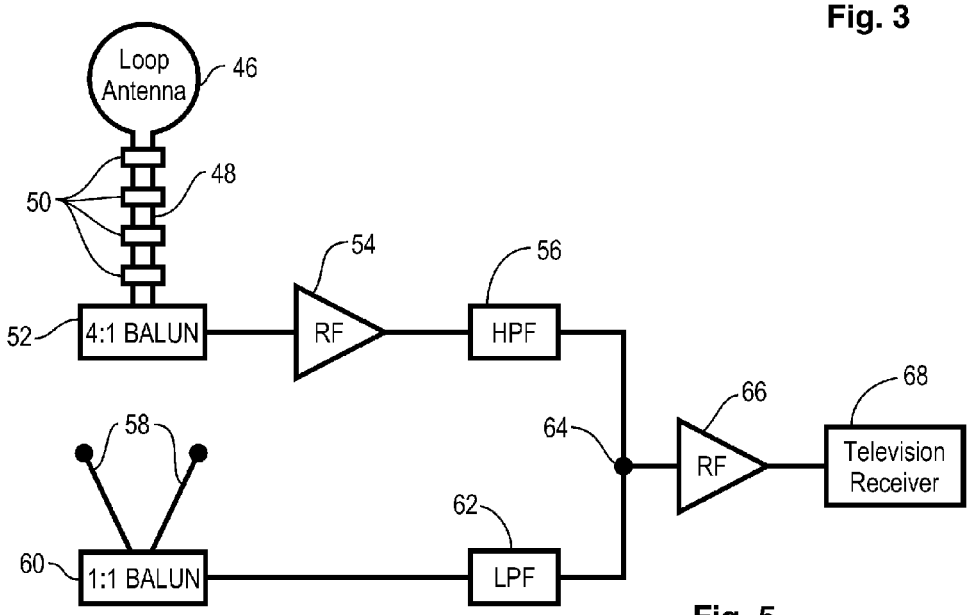
Fig. 5

LOOP ANTENNA WITH IMPEDANCE MATCHING

BACKGROUND OF THE INVENTION

1. Field of the Invention

The present invention relates to radio frequency antennas. More particularly, the present invention relates to low cost HDTV television antenna with impedance matching for a loop element.

2. Description of the Related Art

Prior art television antennas fall into two general categories, the indoor antenna and the outdoor antenna. Indoor antennas are sometimes referred to as set-top antenna, and outdoor antennas are commonly mounted to a mast located above the rooftop of a home or other building. Since US television broadcasts have occurred on both the VHF band (54 MHz to 216 MHz) and the UHF band (470 MHz to 890 MHz), prior art antenna structures have been designed to receive in both of these bands. In fact, most prior art antenna systems have included two antenna structures, one for each band. For example, a common type prior art indoor antenna includes a 7.5" loop antenna for the UHF band and a pair of telescopic dipole elements for the VHF band. The transition to High Definition Television (hereinafter "HDTV") has altered the frequency band utilization. The original US television standard was promulgated as the NTSC standard (National Television System Committee) in 1941, and is well known to those skilled in the art. The United States has since promulgated a new standard, called the ATSC (Advanced Television Systems Committee), which is a digital broadcast format, commonly referred to as HDTV (High Definition Television). The ATSC standard has now been fully implemented in the United States. Additionally, over the decades, the frequency bands have becomes more narrowly defined. For example, the higher UHF channels from 69-83 were reallocated in the 1980s to land mobile radio, which narrowed the UHF TV band to 470 MHz to 806 MHz. Additionally, UHF channels 52-69 have been reallocated, again narrowing the band to 470 MHz to 698 MHz. In a similar vein, the VHF band is also being more narrowly used. The VHF band actually consists of two separate frequency bands, VHF-Low channels 2-6 (54 MHz to 88 MHz) and VHF-H channels 7-13 (174 MHz to 216 MHz).

This changes in frequency utilization and modulation techniques have also affected the required performance from TV antenna systems. This is due to the nature of digital modulation and demodulation, particularly the nature of the demodulation and its effect on subjective reception performance. In prior art NTSC analog television, a gradual reduction in received signal strength resulted in a gradual reduction in received audio and video quality, where acceptability for viewing is subjective in nature. However, in the case to HDTV under the newer ATSC digital modulation, gradual signal level reduction results in the crossing of an abrupt threshold from clear audio and video reception to a sudden and complete loss of received information. Also, generally speaking, HDTV requires a somewhat stronger received signal level to provide comparable performance as compared to analog demodulation. Thus, the transition from the NTSC standard to the ATSC standard has placed a greater demand for improved antenna performance.

The greater demand for antenna performance has not mitigated end user desire for affordability and convenience. This explains why set-top antennas remain in high demand, ostensibly for theirs low cost and convenient installation process. Even though it is well know that a set-top antenna will generally provide smaller received signal strength than a roof-top antenna. Thus, it can be appreciated that there is a need in the art for an improved TV antenna apparatus having enhanced performance and adapted to the new ATSC standard, while still providing the affordability and convenience desired by end users.

SUMMARY OF THE INVENTION

The need in the art is addressed by the apparatus and methods of the present invention. The present invention teaches an antenna apparatus that has a base and an antenna element with a balanced RF output, which receives RF signals within a first band of frequencies. The apparatus includes a mount engaged with the base that rotatably supports the antenna about an axis of rotation. The apparatus has a balun with a balanced RF input and an unbalanced RF output. A feed line is coupled between the balanced RF output and the balanced RF input. The feed line includes two electrical conductors that have a predetermined length and that are aligned substantially in parallel, and supportively spaced apart a predetermined distance by plural insulators. The feed line is further arranged to maintain the predetermined distance between the two electrical conductors as the antenna element rotates with respect to the base. The predetermined length and the predetermined distance are selected to yield a narrow range of impedances within the first band of frequencies as measured at the unbalanced RF output of the balun, which enables efficient coupling of the RF signals from the unbalanced RF output of the balun.

In a specific embodiment, the foregoing apparatus further includes a rotational stop disposed to limit the degree of rotation of the antenna element, and thereby preventing excess twisting of the feed line. In a refinement to this embodiment, the rotational stop limits rotation of the antenna element to approximately plus and minus ninety degrees from a center position. In another specific embodiment, the mount further engages the antenna element to tilt about an axis of tilt that is oriented in a different direction than the axis of rotation. In a refinement to this embodiment, the base is adapted to rest on a horizontal surface, and the axis of rotation is oriented vertically while the axis of tilt is oriented horizontally.

In a specific embodiment of the foregoing apparatus, the balanced output of the antenna element has a nominal impedance of three hundred ohms, and the narrow range of impedances is centered about a nominal fifty to seventy-five ohm impedance. In another specific embodiment, the foregoing apparatus further includes a first radio frequency amplifier with an input coupled to the unbalanced output of the balun. In a refinement to this embodiment, the narrow band of impedances is centered about the nominal impedance of the input to the radio frequency amplifier.

In a specific embodiment of the foregoing apparatus, wherein the band of frequencies is the UHF band, the apparatus further includes a UHF band radio frequency amplifier with an input coupled to the unbalanced output of the balun. A high pass filter receives amplified UHF signals output from the UHF band amplifier, and passes the amplified UHF signals to a first filter output. In addition, the apparatus includes a second antenna element that receives VHF signals, and a VHF low pass filter that passes the VHF signals from the second antenna element to a second filter output. A common output is coupled to receive the amplified UHF signals from the first filter output and the VHF signals from the second filter output. In a refinement to this embodiment, the apparatus further includes a broadband radio frequency amplifier with an input coupled to the common output, and that operates to further amplify the amplified UHF signals and the VHF signals, to a final output. In yet another refinement to this embodiment, the apparatus further includes a power supply circuit with a direct current output that is coupled to provide power to the UHF band amplifier and the broadband radio frequency amplifier. The power supply has a control means adapted to vary the voltage at the direct current output, thereby enabling control of the gain ratio of the UHF band amplifier and the broadband radio frequency amplifier.

The present invention also teaches an amplified television antenna for receiving UHF band and VHF band television broadcast signals. The apparatus includes a base housing that is adapted to rest on a horizontal surface. It includes a UHF loop antenna with balanced output and a nominal impedance of three-hundred ohms, and that receives UHF television signals. There is a mount engaged with the base housing, adapted to rotatably support the UHF loop antenna about a vertical axis of rotation, and further adapted to enable the UHF loop antenna to tilt about a horizontal axis of tilt. The apparatus also includes a VHF telescopic antenna with two telescopic elements attached to the exterior of the base housing, which receives VHF television signals. The apparatus includes a 4:1 balun with a balanced RF input and an unbalanced RF output. A feed line is coupled between the balanced output of the UHF loop antenna and the balanced RF input of the 4:1 balun. The feed line includes two electrical conductors with a predetermined length that are aligned substantially in parallel, and supportively spaced apart a predetermined distance by plural insulators. The feed line is arranged to maintain the predetermined distance between the two electrical conductors as the UHF loop antenna rotates and tilts with respect to the base housing. A rotational stop is disposed to limit the degree of rotation of the UHF antenna to approximately plus and minus ninety degrees from a central position, thereby preventing excessive twisting of the feed line. The apparatus includes a UHF band amplifier with an input coupled to the unbalanced output of the 4:1 balun. The predetermined length and the predetermined distance of the feed line are selected to yield a narrow range of impedances centered about the nominal impedance of the input to the UHF band amplifier, as measured at the unbalanced RF output of the 4:1 balun, which thereby enables efficient coupling of the UHF television signals from the unbalanced RF output of the 4:1 balun to the input of the UHF band amplifier. The apparatus also includes a UHF band high pass filter coupled to received amplified UHF signals output from the UHF band amplifier, and which passes the amplified UHF signals to a first filter output. The apparatus also includes a VHF band low pass filter coupled to pass the VHF signals from the VHF band telescopic antenna to a second filter output. The apparatus includes a broadband radio frequency amplifier having an input coupled to the first filter output and the second filter output, that operates to further amplify the amplified UHF signals and the VHF signals, to a final output. Finally, a power supply circuit with a direct current output is coupled to provide power to the UHF band amplifier and the broadband radio frequency amplifier, and the power supply further includes a control means adapted to vary the voltage at the direct current output, thereby enabling control of the gain ratio of the UHF band amplifier and the broadband radio frequency amplifier.

The present invention also teaches a method of impedance matching in an antenna apparatus having a base, an antenna element rotatably mounted thereon, and a balun. The method includes the steps of receiving RF signals in a first band of frequencies by the antenna element, and, forming a feed line from two electrical conductors of a predetermined length and aligning the two conductors substantially in parallel, and supportively spacing the conductors apart by a predetermined distance using plural insulators. Then, coupling the received RF signals from a balanced output of the antenna through the feed line to a balanced input of the balun, while maintaining the predetermined distance between the two conductors of the feed line as the antenna element is rotated by arranging the feed line to avoid excessive twisting. The method also includes selecting the length of the feed line and the distance between the conductors to yield a narrow range of impedances within the first band of frequencies as measured at an unbalanced RF output of the balun, thereby enabling efficient coupling of the RF signals from the unbalanced RF output of the balun.

In a specific embodiment, the foregoing method further includes the step of preventing excessive twisting of the feed line using a rotational stop disposed to limit the amount of rotation of the antenna element with respect to the base.

In a specific embodiment, the foregoing method further includes the steps of amplifying the RF signals output from the balun by coupling the output of the balun to a first radio frequency amplifier. In addition, the foregoing selecting step further includes the step of centering the narrow range of impedances around the input impedance of the first radio frequency amplifier. In a refinement to this embodiment, wherein the antenna apparatus further includes a power supply circuit with a direct current output that is coupled to provide power to the first radio frequency amplifier, the method further includes the step of varying the output voltage of the power supply using a control means, and thereby controlling the gain ratio of the first radio frequency amplifier.

BRIEF DESCRIPTION OF THE DRAWINGS

FIG. 3 is a physical diagram of a loop antenna, feed line and balun, according to an illustrative embodiment of the present invention.

FIG. 4 is a set of test data for various physical arrangements of a feed line between a loop antenna and a balun according to an illustrative embodiment of the present invention.

FIG. 5 is a functional block diagram of an amplified HDTV antenna according to an illustrative embodiment of the present invention.

DESCRIPTION OF THE INVENTION

Figure 1:
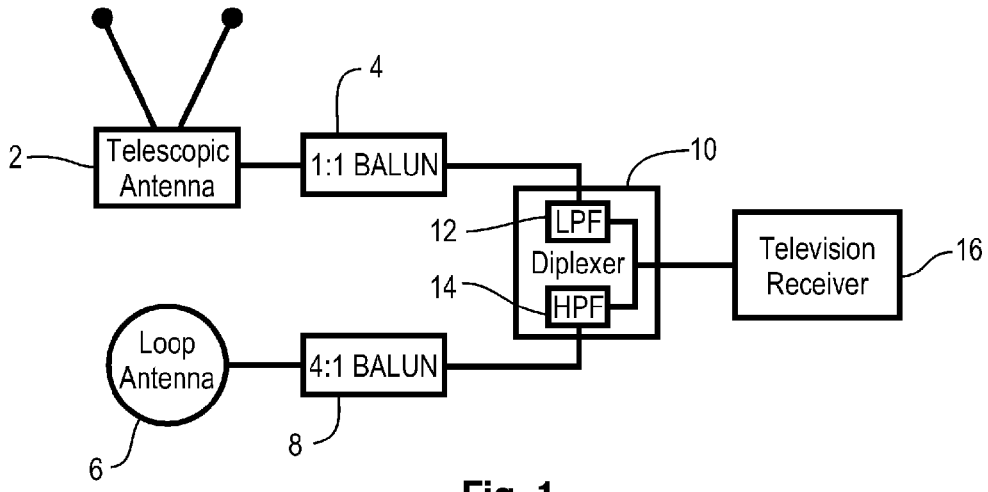
Fig. 1 Prior Art
FIG. 1 is a functional block diagram of a prior art television antenna system.

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope hereof and additional fields in which the present invention would be of significant utility.

In considering the detailed embodiments of the present invention, it will be observed that the present invention resides primarily in combinations of steps to accomplish various methods and components to form various apparatus. Accordingly, the apparatus components and method steps have been represented where appropriate by conventional symbols in the drawings, showing only those specific details that are pertinent to understanding the present invention so as not to obscure the disclosure with details that will be readily apparent to those of ordinary skill in the art having the benefit of the disclosures contained herein.

In this disclosure, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a" does not, without more constraints, preclude the existence of additional identical elements in the process, method, article, or apparatus that comprises the element.

The majority of prior art indoor TV antennas that have been available in the market basically include two antenna structures, a 7.5 inch diameter UHF loop and a VHF dipole made with a pair of telescopic elements. Since the loop antenna has a nominal balanced output impedance to 300-ohms, a 4:1 balun is typically used to convert the received singles to an unbalanced 75-ohm signals. Dipoles have a nominal output impedance of about 75-ohms at a balanced output, therefore, a 1:1: balun is used to convert the balanced output to an unbalanced 75-ohm output. These unbalanced signals can then be coupled using 75-ohm coaxial cable or even 50-ohm coaxial cable and feed lines, as is will known in the art.

Reference is direct to FIG. 1, which is a functional block diagram of a prior art indoor, set-top, television antenna. The prior art antenna system is comprised of two antennas, a 7.5 inch diameter UHF loop 6 coupled through a 4:1 ratio balun 8 and a pair of telescopic whips as a dipole antenna 2 coupled through a 1:1 balun 4. The telescopic whips 2, are commonly referred to as "rabbit ears" have a natural feed point impedance in the 50 to 75 ohm range, so a 1:1 balun 4 is suitable for coupling to unbalanced 50/75 ohm coaxial feed line. The UHF loop 6 has a natural unbalanced feed point impedance in the 300 ohm range, so a 4:1 balun 8 is needed to adapt to the 50/75 ohm unbalanced feed lines used on most TV antenna systems. The gain of the UHF loop element 6 is approximately 2 dBi on its main axis. The TV signals received by the UHF loop 6 and the VHF telescopic antenna 2 are combined by a diplexer 10. The diplexer 10 consists of a low pass filter 12 on the VHF element signal, and a high pass filter 14 on the UHF element signal. This filter arrangement effectively isolates the signals from the two antenna elements from one another. The insertion of the passive baluns and the passive diplexer 10 attenuates the received signals. The output of the diplexer 10 is coupled to a television receiver 16, typically through a 50-ohm or 75-ohm coaxial cable, as are known in the art.

The prior art antenna of FIG. 1 provides modest antenna performance, but with significant attenuated signal loss through the baluns and diplexer filters. In use with an HDTV system, the loss and gain calculations are quite critical, far more so than in the case of prior art analog TV systems. A problem in the prior art designs has been that the actual implementation of the UHF loop antenna with a nominal 300-ohms output, and the effect of coupling through the 4:1 balun, has been that designers tended to ignore the impedance matching issues induced by the physical connections and conductors between the loop and the balun. It has been common that these feed line conductors were either placed closely together without any spacing or they are twisted together. This creates a de facto feed line with unfavorable impedance characteristics. Although the theoretical radiation resistance of the 7.5 inches loop is about 300 ohm, the impedance measured at the output of the balun varied greatly from the desired 50-ohms to 75-ohms, and this is largely due to the fact that the connection between the antenna output and the balun have transformed the 300-ohm output impedance of the loop antenna.

Figure 2:
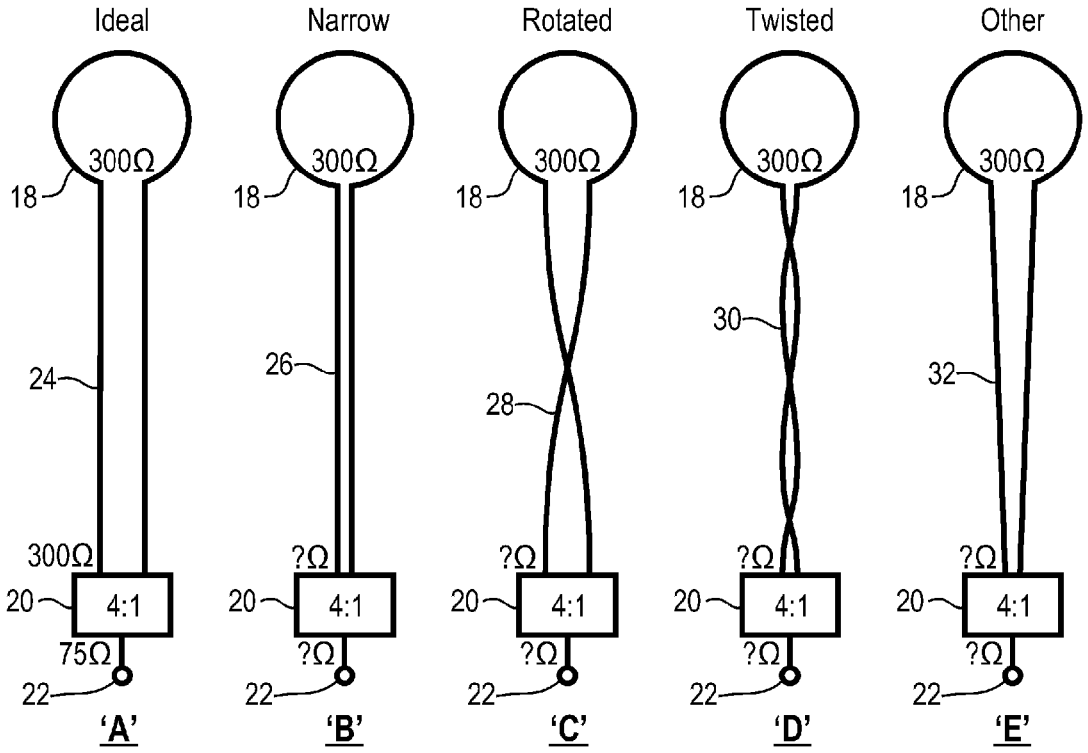
FIG. 2, 'A' through 'E', are diagrams illustrating impedance matching characteristics between a loop antenna and an output to an amplifier.

Reference is directed to FIG. 2, Diagrams 'A' through 'E', which are diagrams illustrating impedance matching characteristics between a loop antenna and the output of a balun. Diagram 'A' presents an ideal arrangement where a loop antenna 18 has an output impedance of 300-ohms. It is coupled to the input of a 4:1 balun 20 using a parallel feed line 24 that has a 300-ohm distributed impedance. Thus, the feed line 24 impedance at the input of the 4:1 balun 20 is 300-ohms, and therefore, the RF signals are coupled to the balun without significant losses. Since the balun 20 is a 4:1 balun, the impedance at the output 22 is 75-ohms. Further, the output 22 is suitable for efficient coupling to a 75-ohm coaxial cable or other 75-ohm circuit. However, the idealized arrangement of Diagram 'A' is not realized in prior art set-top antennas. Diagram 'B' illustrates the case where the feed line conductors 26 are close together, so that the feed line does not present a 300-ohm impedance. In this case, the 300-ohm impedance at the output of the antenna 18 is transformed to an unknown impedance at the input of balun 20, and as such, there is also an unknown impedance at the output 22 of the balun 20. Diagram 'C' illustrates the case where the feed line conductors 28 are spaced for desired 300-ohm impedance, but have been twisted to the point where they cross, so that the 300-ohm line impendence has changed to an unknown impedance. In this case, the 300-ohm impedance at the output of the antenna 18 is transformed to an unknown impedance at the input of balun 20, and as such, there is also an unknown impedance at the output 22 of the balun 20. Diagram 'D' illustrates the case where the feed line conductors 26 are both spaced close together and twisted, so that the line 30 impedance is unknown and varies as a function of frequency. In this case, the 300-ohm impedance at the output of the antenna 18 is transformed to an unknown impedance at the input of balun 20, and as such, there is also an unknown impedance at the output 22 of the balun 20. Diagram 'E' illustrates the case where the feed line conductors 32 are spaced apart a varying distance over the run of the feed line 32 length. In this case, the line 32 impedance is unknown and varies as a function of frequency. Therefore, in this case, the 300-ohm impedance at the output of the antenna 18 is transformed to an unknown impedance at the input of balun 20, and as such, there is also an unknown impedance at the output 22 of the balun 20. As will be appreciated by those skilled in the art, the mismatch of impedance causes a loss of signal power coupled to the input of the balun 20, and an impendence mismatch at the output 22 of the balun with respect to downstream circuitry.

The teaching of the present invention offer significantly improved antenna performance as compared to prior art set-top antenna apparatus. This is accomplished, in part, by tuning the combined design of the loop antenna, feed line and balun to provide an advantageous balun output impedance, calculated to drive downstream RF amplifier or diplexer circuits. In an illustrative embodiment, impedance measurements are taken using a typical 7.5 inch loop antenna (hereinafter referred to as a 190 mm loop antenna for dimensional consistency) and a 75 mm long parallel transmission line, at various transmission line spacings, and through a 4:1 balun, to establish an efficient line spacing calculated to yield the desired impedance at the output of the balun, particularly suited for efficient signal coupling to a subsequent amplifier stage. The measurements are taken across the intended frequency band, which is the UHF television band in the illustrative embodiment.

Reference is directed to FIG. 3, which is a physical diagram of a loop antenna, feed line and balun used as a test circuit and, according to an illustrative embodiment of the present invention. A 190 mm loop antenna 34 is coupled to a parallel feed line 36 that is 75 mm in length 44. The feed line 36 is coupled to a 4:1 balun 38 of conventional design as are known to those skilled in the art. The output 40 of the balun 38 is the test measurement point for output impedance, which measurement are taken as both a function of frequency (in UHF band 470 MHz to 800 MHz) and a function of line 36 spacing "D" 42. FIG. 4 is a table of the test result for the illustrative embodiment. The value and characteristics of the line spacing "D" 42 included 1 mm parallel, 1 mm twisted. 4 mm parallel, 10 mm parallel, and 27 mm parallel. Output impedance measurements were taken across the UHF band, particularly at 470 MHz, 500 MHz, 550 MHz, 600 MHz, 650 MHz, 700 MHz, 750 MHz, and 800 MHz. The measured output impedance values are tabulated in FIG. 4, and will not be repeated here. The bottom row of the table presents the output impedance ratio range. It is noteworthy to mention that the narrow twisted line provided the poorest impedance ratio performance of 22:1 and the wide parallel configurations provided vastly improved ratios, as low as 4:1.

Other circuit tests can be conducted based on particular parameters of any given circuit design, such as a longer of shorter required feed line length, different impedance requirements, and various feed line technologies. With respect to designs for other target output impedances, this is useful in the case where the downstream circuit is a 50-ohm input device, which is common for PCB RF amplifier circuits. If the output impedance varies too far from the 50-ohm amplifier input impedance, the RF signals received by the loop antenna will not be efficiently coupled to the amplifier. It should also be noted that the test and measurement procedure is not limited to 190 mm loop antennas. They can be utilized for any sized loop, as well as square shaped, oval shaped, or bowtie shaped loop antennas, etc. Based on the aforementioned design approach, UHF active loop antenna system having good reception performance can be achieved using the following criteria. It is useful to employ a mechanical stop against antenna rotation and tilt, so as to prevent excessive feed line twisting. In one embodiment, twisting is limited to plus and minus 90-degrees from a central position. The parallel transmission line spacing is maintained through utilization of low cost dielectric spacer elements formed from plastic, paper, tape or other suitable material. Low cost is paramount given the consumer expectation of high value in a set-top antenna apparatus. The spacing of the transmission line structure is selected to confine the loop impedance to a narrow range across the operating band of frequencies, such that the RF signal is efficiently matched to a low noise amplifier to attain optimal noise figure and amplifier signal gain.

Reference is directed to FIG. 5, which is a functional block diagram of an amplified HDTV antenna according to an illustrative embodiment of the present invention. This illustrative embodiment utilizes a 190 mm loop antenna 46 coupled through a 50 mm long feed line 48 that is spaced at 5 mm and coupled to the input of a 4:1 balun. The spacing of the feed line is maintained with plural insulated spacers 50, which are low cost adhesive tape in this embodiment, but may also be cardboard, plastic, rubber, or other insulating polymeric material. The essential characteristics of the spacers 50 are that they be insulators with sufficient rigidity to maintain the lice spacing, and have a low cost. The 50 mm feed line length and 5 mm spacing were selected to achieve an output impedance from the balun 52, which is centered about 50-ohms in the UHF operating band. This is because the output is coupled to the input of a UHF amplifier 54 that has a nominal input impedance of 50-ohms. The UHF amplifier 54 is coupled to a UHF band high pass filter 56, which forms one-half of a diplexer, and which is joined at electrical node 64 with the other half of the diplexer circuit. The antenna system of the illustrative embodiment also includes a VHF dipole antenna 58 that is coupled through a 1:1 balun 60. The balanced output of the balun 60 is coupled through a VHF low pass filter 62, which forms the other half of the diplexer coupled at electrical node 64. The output of the diplexer from node 64 is coupled to a broadband RF amplifier 66, which covers the VHF and UHF television bands. The UHF amplifier 54 has a gain of approximately 10 dB, and the RF amplifier 66 has a gain of approximately 20 dB in the VHF band and approximately 10 dB in the UHF band. The output of the RF amplifier 66 is suitable for coupling to an HDTV television receiver 68.

Figure 6:
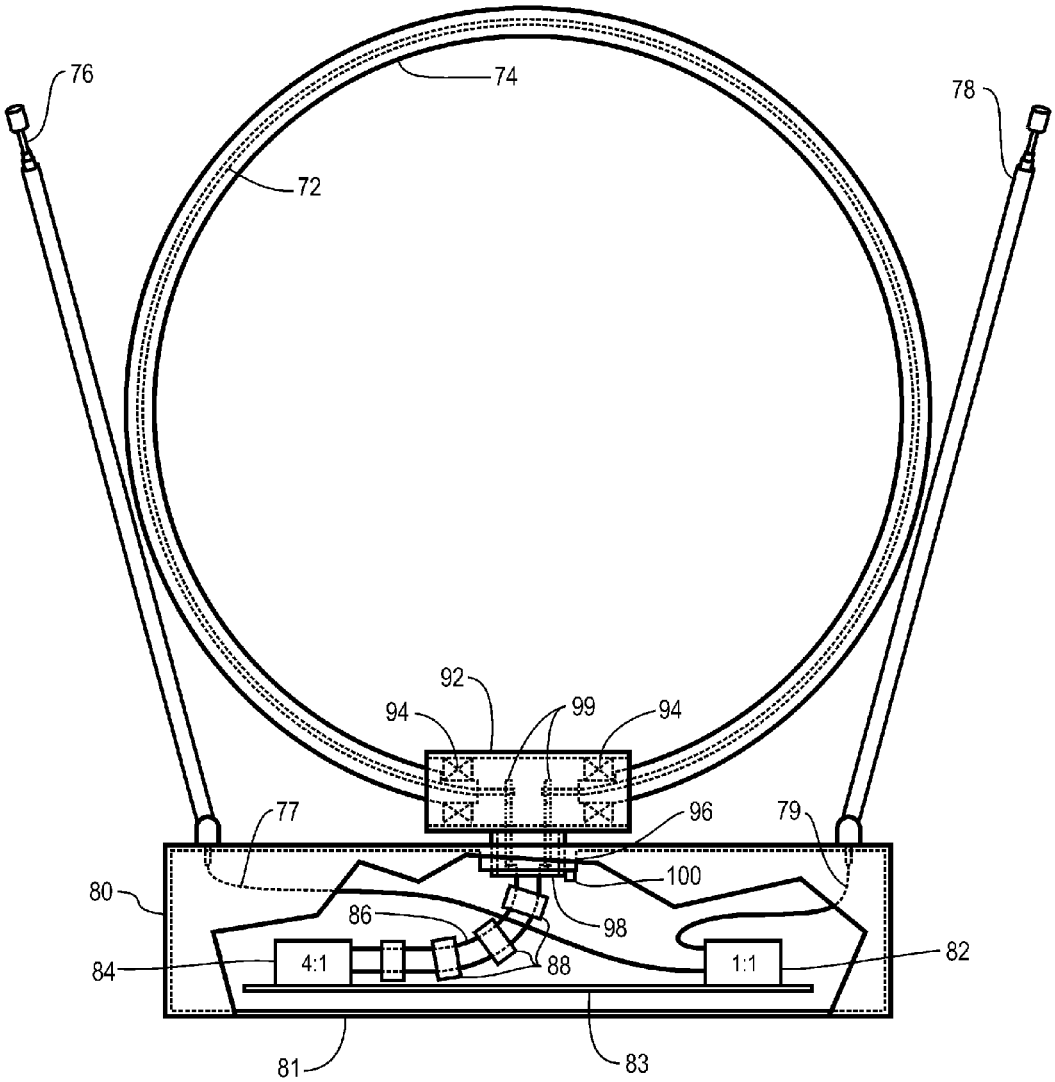
FIG. 6 is a front and partial section view drawing of an amplified HDTV antenna according to an illustrative embodiment of the present invention.

Reference is directed to FIG. 6, which is a front and partial section view drawing of an amplified HDTV antenna according to an illustrative embodiment of the present invention. The antenna system of this illustrative embodiment comprises a pair of telescopic dipole element 76,78 that are adjustably mounted to a base housing 80, which enables the end user to extend and adjust the position of the dipole elements 76,78 to achieve good reception performance in the VHF television band. The base housing is molded from plastic and includes a bottom surface 81 that is adapted to rest on a horizontal surface, although it can be affixed to other surface orientations as well. The dipole elements 76,78 are coupled to a 1:1 balun 82 with electrical conductors 77,79 respectively. The 1:1 balun 82 is of conventional design known to those skilled in the art, and is fixed to a printed circuit board 83 that engages the various circuit components discussed more fully hereinafter.

The antenna system in FIG. 6 further comprises a 190 mm UHF loop element 72, which is disposed within a dielectric raydome 74. The raydome 74 adds rigidity, protects the loop element 72, enhances appearance, and provides a support means to a mount 92 that is disposed between the antenna 72 and the base housing 80. The mount 92 includes a bearing extension 98 that rotatably engages a boss 96 in the base housing 80. Thusly, the loop antenna element 72 and mount 92 are enabled to rotate about a vertical axis of rotation. A mechanical stop 100 is disposed between the boss 96 and the mount bearing extension 98, so as to limit excessive rotation of the antenna element 72. Additionally, the loop antenna element 72 and raydome 74 engage a pair of tilt bearings 94 that enable the loop antenna element 72 to tilt about an axis of tilt defined by the orientation of the tilt bearings 94, which is horizontal and orthogonal to the axis of rotation in the illustrative embodiment. The output of the loop antenna element 72 is coupled to a pair of extensions 99, which enable tilt and connect to a parallel feed line 86. The feed line is 50 mm long and spaced 5 mm apart in the illustrative embodiment. The spacing of the feed line 86 is maintained using plural spacers 88, which are formed from adhesive tape in the illustrative embodiment. The feed line 86 is coupled to a 4:1 balun 84 that is mounted on the printed circuit board 83. During rotation and tilt of the antenna element 72, the spacers 88 on the feed line 86 are arranged to maintain the feed line 86 in substantial parallel, they preserving the desired impedance characteristics of the feed line 86.

Figure 7:
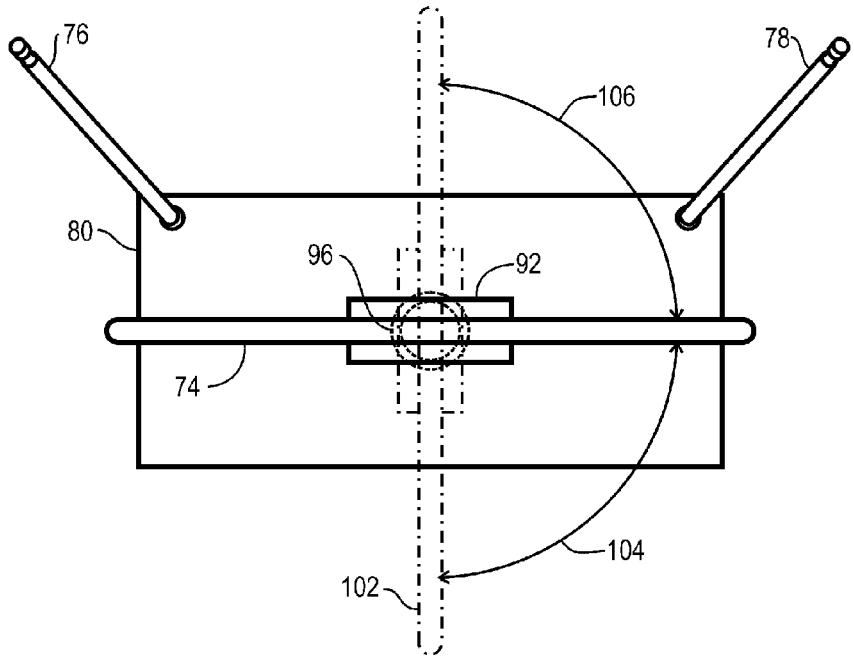
FIG. 7 is a top view drawing of an amplified HDTV antenna according to an illustrative embodiment of the present invention.

Reference is directed to FIG. 7, which is a top view drawing of the amplified HDTV antenna according to an illustrative embodiment of the present invention. The base housing 80 adjustably supports the pair of telescopic dipole elements 76, 78, which can be extended and articulated by the end user to achieve good television reception. The UHF loop element and raydome 74 are rotatably engaged to the base housing 80 by the mount 92 and mounting boss 96, as discussed hereinbefore. The mechanical stop (see FIG. 8, items 100) limits rotation of the antenna and raydome 74 to approximately plus ninety degrees 104 and approximately minus ninety degrees 106 from a central position. The raydome at the rotated extreme is shown in phantom 102 in FIG. 7. The limits of the rotation are determined by the effect such rotation has on feed line twisting, and the ninety degree position is exemplary.

Figure 8:
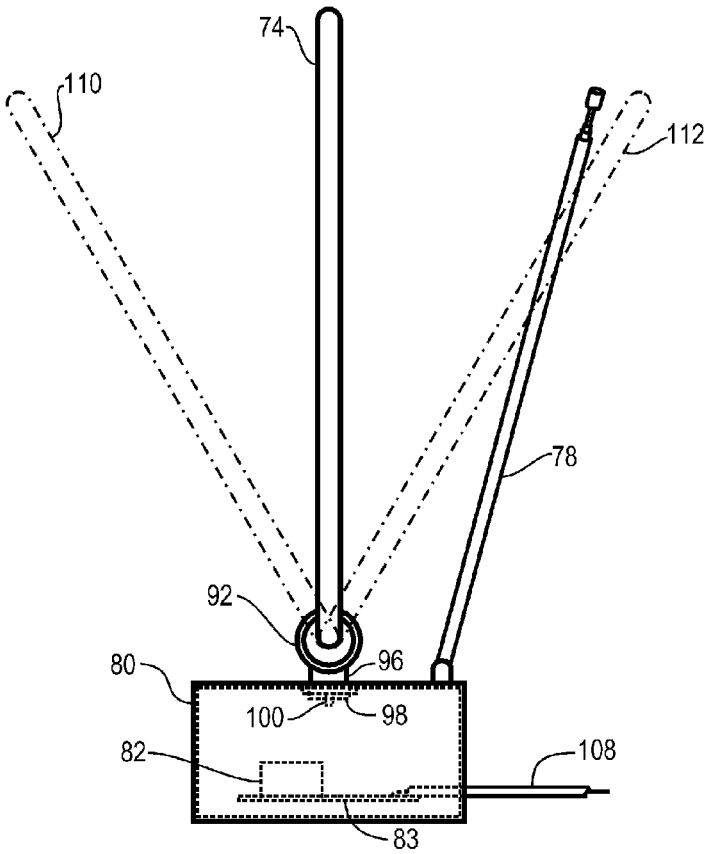
FIG. 8 is a side view drawing of an amplified HDTV antenna according to an illustrative embodiment of the present invention.

Reference is directed to FIG. 8, which is a side view drawing of the amplified HDTV antenna according to an illustrative embodiment of the present invention. The side view illustrates the base housing 80 with the telescopic dipole element 78 in place. The base housing 80 encloses the printed circuit board 83 with balun 82 fixed thereto. A coaxial feed line 108 exits the back of the base housing 80, for connection to an HDTV television receiver. The UHF loop element and raydome 74 are tiltably coupled to the mount 92, which is further rotatably coupled to the base housing 80 by the mount boss 96 and mount bearing extension 98. The mechanical stop 100 limits rotation. The tilt movement is illustrated toward the front 110 and toward the back 112, and as shown in phantom in FIG. 8.

Figure 9:
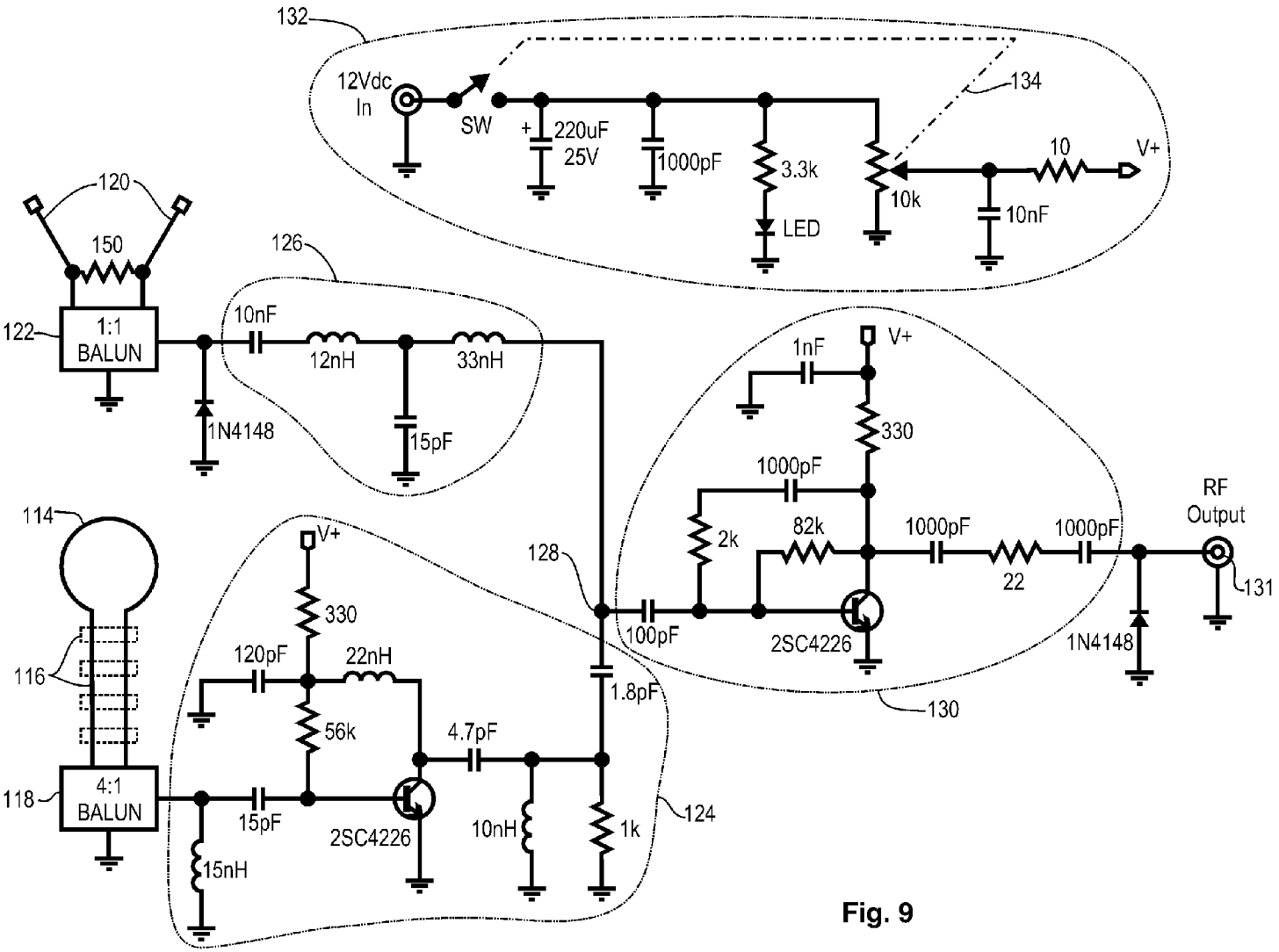
FIG. 9 is a schematic diagram of an amplified HDTV antenna according to an illustrative embodiment of the present invention.

FIG. 9 is a schematic diagram of an amplified HDTV antenna according to an illustrative embodiment of the present invention. The schematic diagram present convention symbols, components values and designators, which are known to those skilled in the art. The VHF dipole elements 120 are coupled to a conventional ferrite 1:1 balun 122, which provides an unbalanced output to a VHF band low pass filter 126. The VHF band low pass filter 126 output is coupled to diplexer common node 128. The UHF loop antenna 114 is connected to a 4:1 ferrite balun 118 through a parallel feed line with insulated spacers 116, as has been described hereinbefore. The 4:1 balun 118 provides an unbalanced output to a +10 dB gain tuned UHF amplifier and UHF band high pass filter stage 124. The output of this stage 124 is coupled to the diplexer common node 128. The diplexer common node then feeds the VHF band signals and the amplified UHF band signals to a broadband RF amplifier stage 130. The broadband RF amplifier is configured to provide approximately +10 dB gain in the UHF band, and +20 dB gain in the VHF band. This yields an overall gain across both bands of approximately +20 dB to RF output 131, which is coupled to an HDTV television receiver. A power supply circuit 132 is included to provide regulated power (V+) to the amplifiers. The gain of the amplifiers is controlled by varying the output voltage (V+) from the power supply circuit 132. This is accomplished with ganged potentiometer and power switch 134.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. An antenna apparatus, comprising:

a base;

an antenna element having a balanced RF output having a nominal impedance of 300 ohms, and operable to receive RF signals within a first band of frequencies;

a mount engaged with said base, and adapted to rotatable support said antenna about an axis of rotation;

a balun having a balanced RF input and an unbalanced RF output, and having an impedance ratio of 4:1 therebetween, which provides a nominal impedance transformation from 300 ohms to 75 ohms, said unbalanced output coupled to a circuit having a circuit impedance of 50 ohms;

a feed line coupled between said balanced RF output and said balanced RF input, and wherein said feed line comprises two electrical conductors having a predetermined length of 75 millimeters and aligned substantially in parallel, and supportively spaced apart a predetermined distance of 5 millimeters by plural insulators, said feed line further arranged to maintain said predetermined distance between said two electrical conductors as said antenna element rotates with respect to said base, and wherein said predetermined length and said predetermined distance are selected to yield a narrow range of impedances within said first band of frequencies that are substantially centered about said circuit impedance of 50 ohms after being multiplied by said 4:1 impedance ratio, thereby enabling efficient coupling of said RF signals from said balanced RF output having a nominal impedance of 300 ohms to said circuit having a circuit impedance of 50 ohms.

2. The apparatus of claim 1, further comprising:

a rotational stop disposed to limit the degree of rotation of said antenna element, and thereby preventing excess twisting of said feed line.

3. The apparatus of claim 2, and wherein:

said rotational stop limits rotation of said antenna element to approximately plus and minus ninety degrees from a center position.

4. The apparatus of claim 1, and wherein:

said mount further engages said antenna element to tilt about an axis of tilt that is oriented in a different direction than said axis of rotation.

5. The apparatus of claim 4, and wherein:

said base is adapted to rest on a horizontal surface, and said axis of rotation is oriented vertically and said axis of tilt is oriented horizontally.

6. The apparatus of claim 1, and wherein:

said circuit comprises a first radio frequency amplifier having an input coupled to said unbalanced output of said balun.

7. The apparatus of claim 1, wherein said band of frequencies is the UHF band, and further comprising:

a UHF band radio frequency amplifier, as a portion of said circuit, having an input coupled to said unbalanced output of said balun;

a high pass filter coupled to received amplified UHF signals output from said UHF band amplifier, and operable to pass said amplified UHF signals to a first filter output;

a second antenna element adapted to receive VHF signals;

a VHF low pass filter coupled to pass said VHF signals from said second antenna element to a second filter output, and a common output coupled to receive said amplified UHF signals from said first filter output and coupled to receive said VHF signals from said second filter output.

8. The apparatus of claim 7, further comprising:

a broadband radio frequency amplifier having an input coupled to said common output, and operable to further amplify said amplified UHF signals and said VHF signals, to a final output.

9. The apparatus if claim 8, further comprising:

a power supply circuit having a direct current output coupled to provide power to said UHF band amplifier and said broadband radio frequency amplifier, and said power supply having a control means adapted to vary the voltage at said direct current output, thereby enabling control of the gain ratio of said UHF band amplifier and said broadband radio frequency amplifier.

10. An amplified television antenna for receiving UHF band and VHF band television broadcast signals, comprising:

a base housing adapted to rest on a horizontal surface;

a UHF loop antenna having a balanced output with a nominal impedance of three-hundred ohms, and operable to receive UHF television signals;

a mount engaged with said base housing, adapted to rotatably support said UHF loop antenna about a vertical axis of rotation, and further adapted to enable said UHF loop antenna to tilt about a horizontal axis of tilt;

a VHF telescopic antenna comprising two telescopic elements attached to the exterior of said base housing, operable to receive VHF television signals;

a 4:1 impedance ratio balun, which provides a nominal impedance transformation of 300 ohms to 75 ohms, having a balanced RF input and an unbalanced RF output;

a feed line coupled between said balanced output of said UHF loop antenna and said balanced RF input of said 4:1 balun, and wherein said feed line comprises two electrical conductors having a predetermined length of 75 millimeters and aligned substantially in parallel, and supportively spaced apart a predetermined distance of 5 millimeters by plural insulators, said feed line further arranged to maintain said predetermined distance between said two electrical conductors as said UHF loop antenna rotates and tilts with respect to said base housing;

a rotational stop disposed to limit the degree of rotation of said UHF antenna to approximately plus and minus ninety degrees from a central position, thereby preventing excessive twisting of said feed line;

a UHF band amplifier having an input coupled to said unbalanced output of said 4:1 balun, and having an input impedance of nominal fifty ohms, and wherein said predetermined length and said predetermined distance of said feed line are selected to yield a narrow range of impedances centered about the nominal 50 ohm impedance of said input to said UHF band amplifier, after being multiplied by the 4:1 impedance ratio, thereby enabling efficient coupling of said UHF television signals from said balanced output with a nominal impedance of three-hundred ohms to said input of said UHF band amplifier having an input impedance of nominal fifty ohms;

a UHF band high pass filter coupled to received amplified UHF signals output from said UHF band amplifier, and operable to pass said amplified UHF signals to a first filter output;

a VHF band low pass filter coupled to pass said VHF signals from said VHF band telescopic antenna a second filter output, and a broadband radio frequency amplifier having an input coupled to said first filter output and said second filter output, and operable to further amplify said amplified UHF signals and said VHF signals, to a final output;

a power supply circuit having a direct current output coupled to provide power to said UHF band amplifier and said broadband radio frequency amplifier, and wherein said power supply comprises a control means adapted to vary the voltage at said direct current output, thereby enabling control of the gain ratio of said UHF band amplifier and said broadband radio frequency amplifier.

11. A method of impedance matching in an antenna apparatus having a base, an antenna element rotatably mounted thereon, to a circuit having a 50 ohm circuit impedance, using a balun having a 4:1 impedance ratio, which provides a nominal impedance transformation from 300 ohms to 75 ohms, the method comprising the steps of:

receiving RF signals in a first band of frequencies by the antenna element having a 300 ohm balanced RF output;

forming a feed line from two electrical conductors of a predetermined length of 75 millimeters and aligning the two conductors substantially in parallel, and supportively spacing the conductors apart by a predetermined distance of 5 millimeters using plural insulators;

coupling the received RF signals from a 300 ohm balanced RF output of the antenna element through the feed line to a balanced input of the balun;

maintaining the predetermined distance between the two conductors of the feed line while the antenna element is rotated by arranging the feed line to avoid excessive twisting, and selecting the length of the feed line and the distance between the conductors to yield a narrow range of impedances within the first band of frequencies that are substantially centered about the 50 ohm circuit impedance after being multiplied by the 4:1 impedance ratio, thereby enabling efficient coupling of the RF signals from the 300 ohm balanced RF output of the antenna element to the 50 ohm circuit.

12. The method of claim 11, further comprising the step of:

preventing excessive twisting of the feed line using a rotational stop disposed to limit the amount of rotation of the antenna element with respect to the base.

13. The method of claim 11, further comprising the steps of:

amplifying the RF signals output from the balun by coupling the output of the balun to a first radio frequency amplifier.

14. The method of claim 13, wherein the antenna apparatus further includes a power supply circuit with a direct current output that is coupled to provide power to the first radio frequency amplifier, the method further comprising the step of:

varying the output voltage of the power supply using a control means, and thereby controlling the gain ratio of the first radio frequency amplifier.

* * * * *

UNITED STATES PATENT AND TRADEMARK OFFICE

CERTIFICATE OF CORRECTION

PATENT NO. : 8,736,500 B1
APPLICATION NO. : 12/536256
DATED : May 27, 2014
INVENTOR(S) : Alan Man Lung Lam It is certified that error appears in the above-identified patent and that said Letters Patent is hereby corrected as shown below:

In the Specification

Column 5, line 46, change the word “will” to --well--.

Column 5, line 56, change the word “unbalanced” to --balanced--.

Column 7, line 45, change the word “of” to --or--.

Column 8, line 17, change the word “lice” to --line--.

Column 9, line 13, change the word “they” to --thus--.

In the Claims

Column 10, line 19, which is the 6th line in Claim 1, change “rotatable” to --rotatably--.

Signed and Sealed this
Twenty-ninth Day of July, 2014

Michelle K. Lee

Michelle K. Lee
*Deputy Director of the United States Patent and Trademark Office*